US005531882A

United States Patent [19]

Sitges Menendez et al.

[11] Patent Number: 5,531,882

[45] Date of Patent: Jul. 2, 1996

[54] PROCEDURE FOR CLEANING THE ANODES OF ELECTROLYTIC TANKS

[75] Inventors: Francisco Javier Sitges Menendez, Madrid; Fernando Sitges Menendez, Salinas (Asturias); Francisco Alvarez Tamargo, Luanco (Asturias); Jose Maria Martinez Valdes, Arnao-Castrillon (Asturias), all of Spain

[73] Assignee: Asturiana De Zinc, S.A., Spain

[21] Appl. No.: 535,455

[22] Filed: Sep. 28, 1995

Related U.S. Application Data

[62] Division of Ser. No. 261,402, Jun. 17, 1994.

[30] Foreign Application Priority Data

Sep. 24, 1993 [ES] Spain ..... 9302030

[51] Int. Cl.[6] ..... C25C 7/06

[52] U.S. Cl. ..... 205/602; 204/194; 29/81.05; 29/81.08; 29/DIG. 7

[58] Field of Search ..... 205/602; 29/81.05, 29/81.08, DIG. 7; 204/194

[56] References Cited

U.S. PATENT DOCUMENTS

| | | | |
|---|---|---|---|
| 3,501,795 | 3/1970 | Jasberg | 15/77 |
| 4,406,753 | 9/1983 | Blake et al. | 204/10 |
| 4,595,421 | 6/1986 | Redhead et al. | 134/6 |
| 4,903,520 | 2/1990 | Hukkanen et al. | 72/309 |

FOREIGN PATENT DOCUMENTS

| | | |
|---|---|---|
| 0068855 | 1/1983 | European Pat. Off. . |
| 0084521 | 7/1983 | European Pat. Off. . |
| 3812850 | 4/1988 | Germany . |
| 1449545 | 1/1974 | United Kingdom . |

*Primary Examiner*—Arun S. Phasge
*Attorney, Agent, or Firm*—Ostrolenk, Faber, Gerb & Soffen

[57] ABSTRACT

A procedure and machine for cleaning the anodes of electrolytic tanks, said procedure comprising the operations of mechanically breaking the deposits on the surfaces of the anodes, detaching and separating the deposits, once broken, and then subjecting the plate of the anodes to a flattening operation. The procedure is carried out with a machine which includes at least one pair of cutting rollers (1), nozzles for supplying jets of water under pressure (2) situated above said rollers (1), two flattening plates (3) with flat opposing surfaces, and means of suspending and raising the anodes (13) between the rollers (1), nozzles (2) and plates (3). The plates (3) may be provided on their opposing surfaces with cutting grooves.

7 Claims, 5 Drawing Sheets

FIG. 4
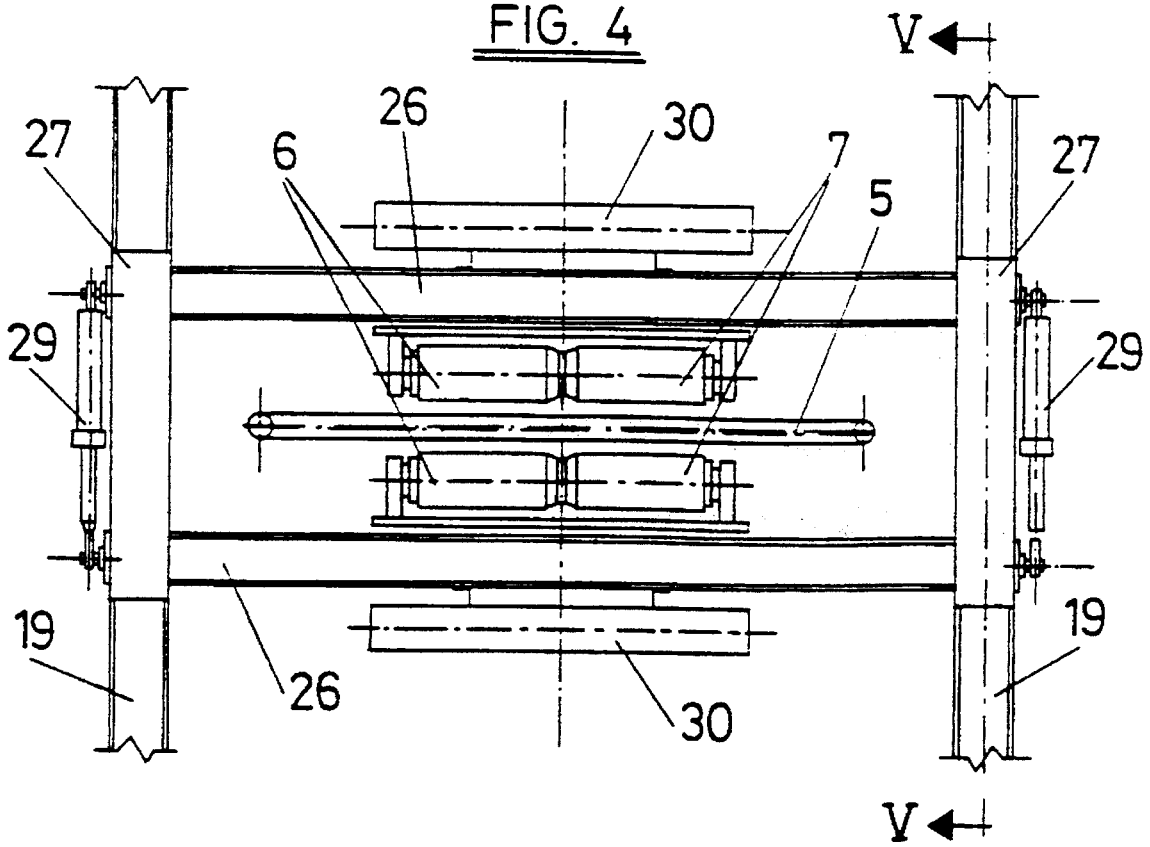
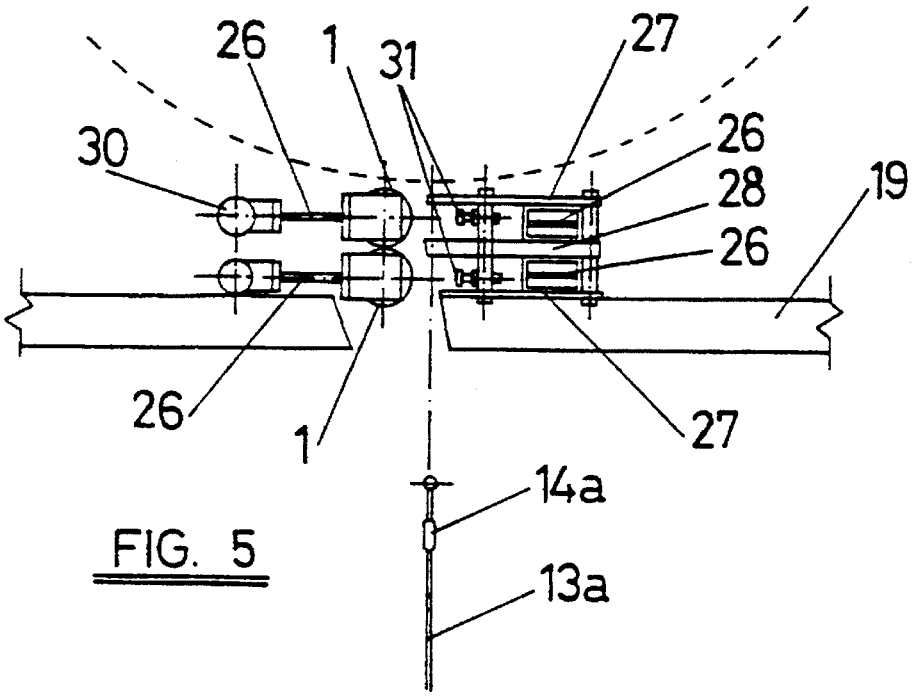
FIG. 5

PROCEDURE FOR CLEANING THE ANODES OF ELECTROLYTIC TANKS

This is a division of application Ser. No. 08/261,402, filed Jun. 17, 1994.

The present invention relates to a procedure for cleaning the anodes of electrolytic tanks, designed in particular for cleaning the anodes used in processes for the production of non-ferrous metals by electrolysis, such as zinc and copper. A further object of the invention is a machine for the realization of said cleaning procedure.

BACKGROUND OF THE INVENTION

During the process of electrolysis for the production of metals of the type indicated above, and in particular for the production of zinc and the like, a layer formed by sediments contained in the electrolyte, basically consisting of manganese dioxide ($MnO_2$), is deposited on the anode.

This layer grows thicker with time and acts as an electrical resistance. As the width of the layer increases so does the voltage required to cause a certain current to flow, which confirms that the deposit increases the consumption of electrical energy and should therefore be eliminated in the most effective way possible if the optimum conditions in the process of electrolysis are to be maintained.

Furthermore, the width of the layer increases in a uniform manner until it reaches a certain limit, after which kinds of trees are formed and which, once they have started, grow rapidly due to the fact that the conduction of current is greater through them as a result of the "points" effect and their increasingly shorter distance from the cathode.

When one of these points touches a cathode a short circuit is produced. This short circuit always damages the anode, causing torsions or holes which, apart from deteriorating the anode, mean that lead is transferred to the electrolyte and later deposited with the zinc, making the production thereof impure.

For these reasons, the anodes must be cleaned periodically in an effective and efficient way in order to ensure correct electrical behaviour and performance, and frequently enough to prevent the creation of possible short circuits which would contaminate the zinc deposits.

Various procedures for carrying out the cleaning of the anodes in order to prevent the above mentioned problems are already known and among them it is worth mentioning the following three:

a) By means of jets of water under pressure;

b) By means of plates with flat opposing surfaces between which the anode is situated and pressed;

c) By means of metal brushes.

The first of these systems requires equipment to supply water under pressure, said equipment requiring a high level of maintenance and giving rise to an excessive consumption of water. Furthermore, the level of noise during the cleaning process by means of the jets of water is high and in addition the result obtained is not totally satisfactory, due basically to the different adhesive forces of the deposits and the different forces with which the water impinges.

With the second of the systems mentioned, the cleaning operation is carried out by pressing the anodes between two plates with parallel surfaces. This action tries to break the deposits and detach them from the surface of the anode. Nevertheless, in many cases it causes the impurities to compact onto the anode until they are encrusted therein, making them practically impossible to eliminate.

Finally, in the third system mentioned the cleaning is carried out by eroding the deposits by the action of brushes with metal bristles. During the cleaning process a certain amount of erosion of the surface of the anode is also produced, giving rise to their premature deterioration. Similarly, when the brushes are in use the bristles wear away progressively. This wear is non-uniform which means that the subsequent action of the brushes on the anodes is non-uniform as well, giving rise to irregular cleaning.

Whichever cleaning system is used, the anode is subjected afterwards to a flattening process, since for the process of electrolysis the anodes and cathodes must have flat surfaces due to the proximity between them.

DESCRIPTION OF THE INVENTION

The object of the present invention is a procedure for cleaning anodes by means of which the total and effective cleaning of said anodes is achieved, without risk of the deterioration thereof. Furthermore, the procedure of the invention enables the cleaning of all types of anodes (laminated, cast, grooved surface, etc.) to be carried out in a relative short period of time.

A further object of the invention is a machine by means of which the process of cleaning the anodes is carried out, with the characteristics and advantages described.

According to the present invention, the cleaning procedure comprises, in combination, the following stages: a) mechanically breaking the deposits on the surfaces of the anodes by means of series of cutting lines made in the deposits; b) detaching and separating the broken deposits from the surfaces of the anodes by means of jets of water under pressure; and c) subjecting the plate of the anodes to a flattening operation.

According to the invention the cutting lines are made with one or two pairs of parallel rotating rollers which are provided on their lateral surface with helical cutting grooves, the anode being passed between said rollers, the separation between the grooves of both rollers being maintained approximately equal to the thickness of the anodes.

The separation of the rollers is such that they do not produce indentations on the lead plate of the anode during the process of breaking the deposits. This can be achieved by means of adjustable stops which limit the minimum distance between the rollers.

The detaching phase by means of jets of water under pressure can be carried out using directed rows of nozzles to act on both surfaces of the anode.

According to the invention the process described is carried out by means of a machine comprising at least one pair of parallel horizontal cutting rollers situated at the same height, two series of nozzles for supplying jets of water under pressure and situated above said rollers, two plates situated above said nozzles and which are each suspended by their horizontal upper axes and have flat opposing surfaces, and means of suspending and raising the anodes between the rollers, between the series of water jets and between said two plates.

The rollers are rotating, their separation can be adjusted and they are provided on their lateral surface with helical cutting grooves at a constant height. Preferably, each cutting roller is provided on its lateral surface with two symmetrical helical grooves which begin at the central mid-plane and run towards the end sections of the rollers. Furthermore, the grooves of each roller run in a different direction to those of the adjacent rollers.

The machine may comprise two pairs of horizontal cutting rollers situated at a different height and with the above mentioned characteristics.

The rollers of each pair are mounted on supports which can be moved in the direction perpendicular to said rollers. These supports are interconnected by means of actuating cylinders whose travel towards the rollers is limited according to the thickness of the anode and the surface deposits of impurities.

The nozzles for supplying water under pressure and the flattening plates between them occupy symmetrical positions relative to the vertical mid-plane which passes between the pair or pairs of rollers, the nozzles being directed towards said plane and the plates pivoting about the suspension axes between a closed position, in which they are parallel, and an angular opened position.

The means of suspending and raising the anodes consists of a lift comprising a flat vertical chassis whose length is greater than the head of the anodes, said chassis being provided below, starting from its vertical sides, with opposing brackets for supporting the ends of the head of the anodes.

The phases of breaking the deposits and flattening the plate of the anodes can be carried out together by means of two plates which are provided on one of their surfaces, with fine ribs provided with a free cutting edge, said plates being opposed and positioned at the same time against the surfaces of the anode, one on each side, to simultaneously produce cutting lines in the deposits as well as the flattening of the anode.

BRIEF DESCRIPTION OF THE DRAWINGS

All the characteristics of the present invention are described below in greater detail with reference to the accompanying drawings which show by way of a non-limiting example one practical embodiment thereof.

In the drawings:

FIG. 4 is a plan view of the cutting rollers of the machine shown in FIG. 3.

FIG. 5 is a section taken along the line V—V of FIG. 4.

DESCRIPTION OF A PREFERRED EMBODIMENT

Figure 1:
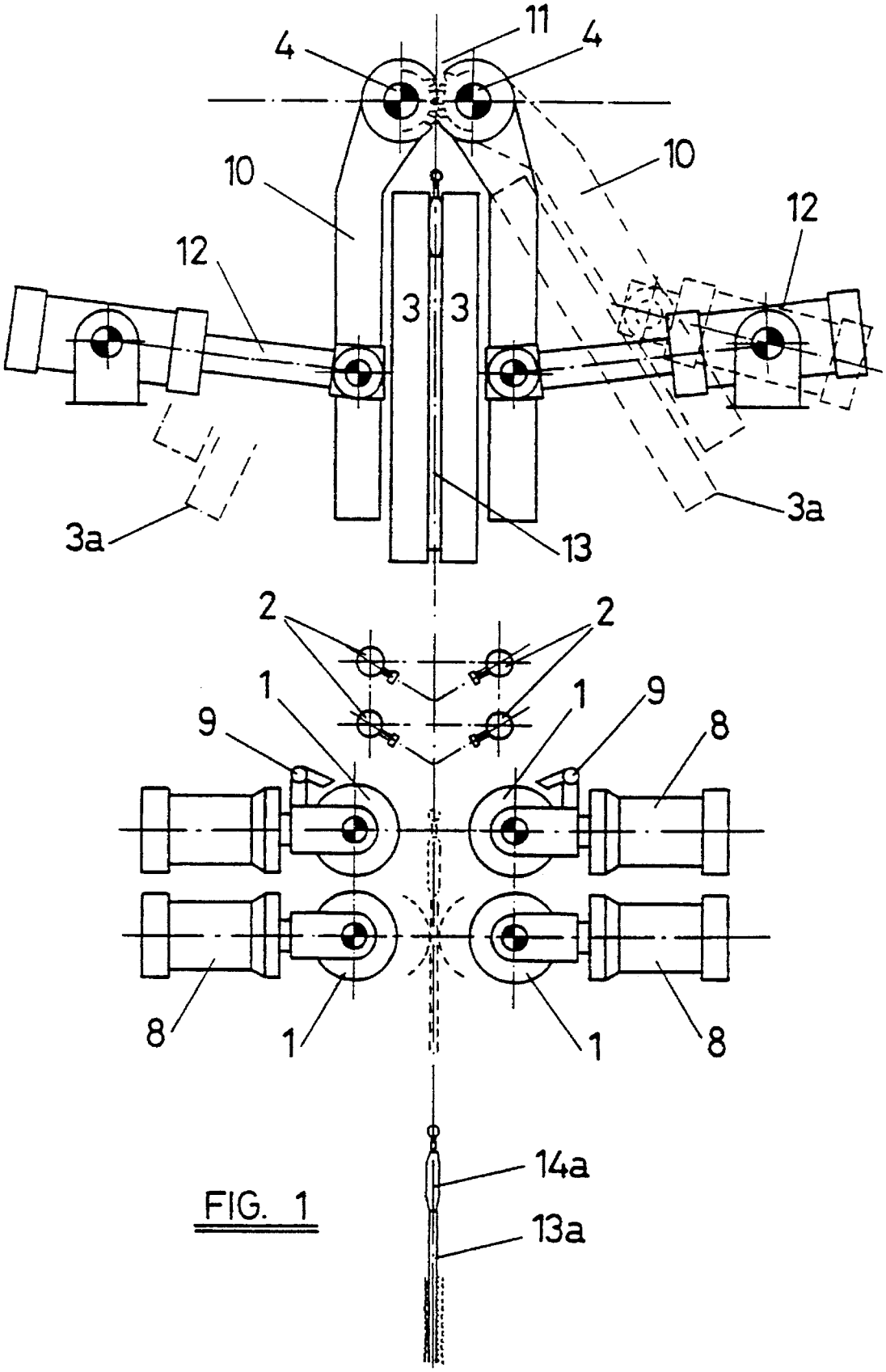
FIG. 1 is a schematic lateral elevation of a machine for cleaning the anodes of electrolytic tanks.
Figure 2:
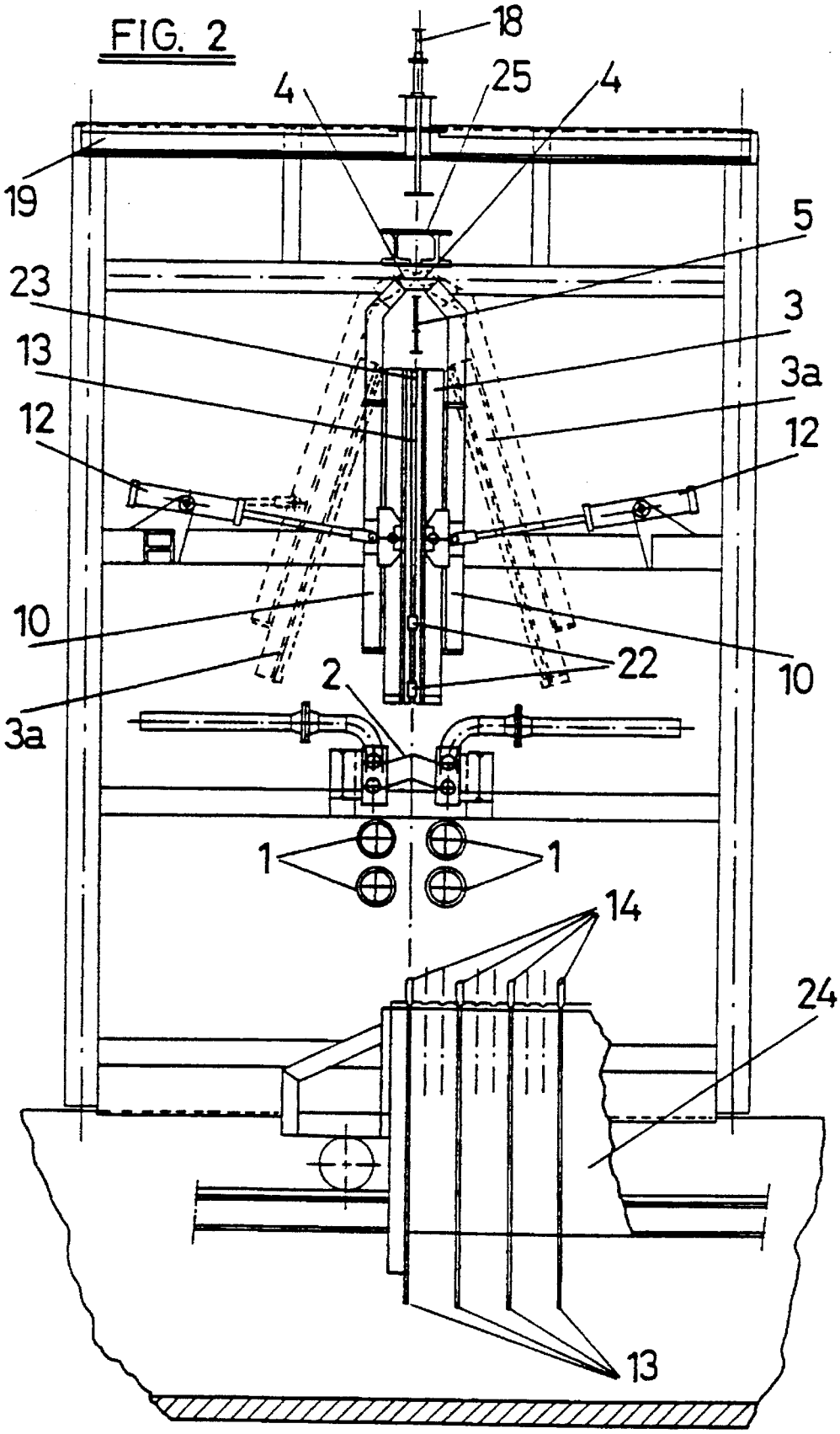
FIG. 2 is a similar view to that of FIG. 1 showing a possible system of assembly of the different components of the machine.
Figure 3:
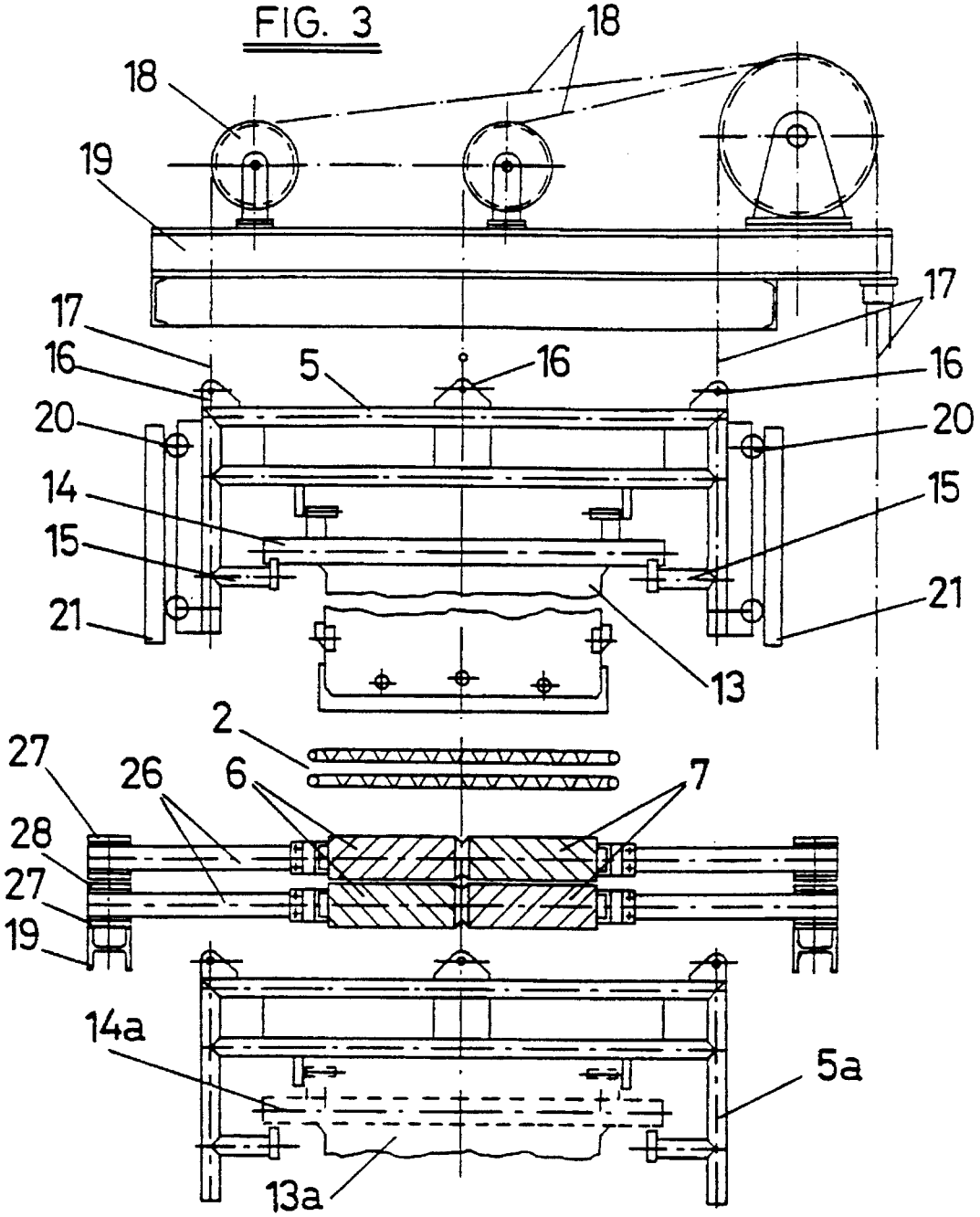
FIG. 3 is a schematic frontal elevation of the machine.

The machine for cleaning the anodes of electrolytic tanks shown in FIGS. 1 to 3 comprises parallel horizontal cutting rollers 1, two series of nozzles 2 for supplying jets of water under pressure and situated above the rollers 1.

Two plates 3 are situated above said nozzles and are each suspended by their horizontal upper axes 4, and means 5 are provided for suspending and raising the anodes.

The rollers 1 are freely rotating and arranged in pairs, the two rollers of each pair being situated at the same height and the rollers of each of the pairs being situated in coincident vertical planes, as shown in FIG. 1. Furthermore, the separation of the rollers of each pair can be adjusted.

The rollers 1 are made of an acid resistant material and, as can best be seen in FIGS. 3 and 4, each consist of two halves 6 and 7, each of which is provided on its lateral surface with a helical cutting groove with opposing threads. Furthermore, the rollers are arranged such that the grooves of adjacent rollers also have opposing threads.

Returning to FIG. 1, the rollers 1 are mounted on supports 8 which enable the separation between the rollers of each pair to be adjusted. Finally, close to the rollers 1 nozzles 9 may be provided for supplying water under pressure for cleaning said rollers.

The nozzles 2 may be arranged in two rows and supply water under pressure to detach the deposits from the anodes after they have been broken by the cutting rollers 1.

The plates 3 are mounted on supports 10 which are in turn mounted by their above mentioned upper axes 4. These supports 10 may be interconnected by means of an upper system of gears 11 which ensure the synchronized angular movement between the supports and the plates. The actuation of the supports 10 with their corresponding plates 3 may be carried out by means of hydraulic cylinders 12.

The plates 3 mounted on the supports 10 can pivot between a parallel closed position, shown in FIG. 1, in which the opposing surfaces of the plates rest on the plate 13 of the anode, and an angular opened position 3*a*, represented by the broken lines, in which the supports 10 and their corresponding plates are separated from each other, enabling the anodes 13 to be raised and lowered.

The mechanisms 5 for suspending the anodes (FIG. 3) may consist of a lift comprising a flat vertical chassis whose length is greater than the head 14 of the anodes 13 and which is provided below, starting from its vertical sides, with opposing brackets 15 for supporting the ends of the head 14 of the anodes. The chassis 5 is provided above with tabs 16 with holes for connecting the suspension cables 17 which pass through pulleys 18 mounted on a structure 19, said cables being connected to an actuating mechanism. The chassis 5 is provided on its sides with sliding means 20 which are supported by vertical tracks 21 and which ensure the travel of the chassis 5, keeping it in the correct position.

FIG. 3 shows the chassis 5*a* of the anode suspension elements in its lowered position ready to receive the head 14*a* of an anode 13*a*. As the anode suspension means 5 are raised the chassis and anode pass successively between the pairs of rollers 1 and the nozzles 2 for supplying water under pressure until they reach the raised position in which they are situated between the plates 3.

FIG. 2 shows in greater detail the structure 19 on which the pulleys 18 are mounted, as well as the assembly of rollers 1 and nozzles 2 for supplying water under pressure.

As can best be seen in FIG. 2, the plates 3 are provided on their opposing surfaces with lower undercuts 22 and upper undercuts 23 for fitting the head 14 of the anodes and the lower stops or separators thereof when said plates are in the parallel closed position.

As is also shown in FIG. 2, the machine may include a carriage 24 for carrying the anodes 13 and which can position an anode in the right place to be picked up by the suspension means 5 which will raise it such that it passes between the rollers 1 and the nozzles 2 for supplying water under pressure until they are situated between the plates 3, from where they are lowered again until they are released in a place corresponding to the carriage 24.

The speeds at which the anodes are raised and lowered are adjustable, and furthermore during these movements, as the they pass through different positions or points, they trigger sensors which are able to activate the different mechanisms for cleaning by means of the cutting rollers 1, jets of water under pressure 2 and flattening plates 3.

FIG. 2 shows a head 25 mounted on the structure 19 and from which the supports 10 that carry the plates 3 are suspended by means of the horizontal axes 4.

Each,pair of rollers 1 is supported by parallel beams 26 which are mounted at their ends between end plates 27 and an intermediate plate 28 (FIG. 3), said plates being supported by the structure 19. The beams 26 of each pair of rollers 1 are inter-connected by their ends by means of cylinders 29 (FIG. 4), the activation of said cylinders separating or bringing closer together the beams 26 and therefore the rollers 1. The beams 26 are also provided with external counterweights 30.

Adjustable stops 31 are arranged between the end plates 27 and central plate 28 (FIG. 5), said stops limiting the minimum distance between the beams 26 and therefore the minimum distance between the rollers 1 of each pair. The stops 31 are adjusted such that when the rollers are at their minimum distance they do not produce indentations in the lead plate of the anode. The stops 31 are adjusted to the width of the anode such that the helical cutting grooves of the rollers penetrate only into the deposited layer which is to be eliminated, without penetrating into the lead of the anode plate.

The procedure for cleaning the anodes using the machine described starts with the arrival of a dirty anode which the anode-carrying carriage 24 (FIG. 2) positions ready to be picked up by the lifting means 5. The lifting mechanism situated in the lower position 5*a* (FIG. 3) picks up the anode 13*a* and starts to raise it at a pre-determined constant speed. When, in its upward movement, the head 14*a* of the anode passes the first line or pair of rollers 1 these are brought together by the activation of the cylinders 29 (FIG. 4) until they are separated by a distance which is equal to the thickness of the lead plate of the anode, previously set with the stops 31 (FIG. 5). In this way the helical cutting threads of rollers dig into the layer of sludge deposited on the surfaces of the anode. Subsequently, as a result of the upward movement of the anodes, the friction between them and the rollers 1 and their helical cutting threads cause them to rotate and their helical cutting threads produce a number of cracking or cutting lines on the layer of sludge deposited on the anodes.

When the head 14 of the anode passes between the pair of upper rollers 1 the same process is repeated, producing cutting lines in the sediments which cross those produced by the lower pair of rollers. In this way the layer of sediments is completely cut by a series of inter-crossed cracking lines.

Whilst the rollers are in operation water is continuously supplied via the nozzles 9 (FIG. 1) in order to keep the surface of said rollers clean.

The anode continues to rise, with the layer of sediments now cut, and as it passes between the nozzles 2 a process of irrigation begins using water under pressure and which is sufficient to lift the entire layer of sediment previously fragmented by the rollers 1. This cleaning phase affects the speed with at which the anode are raised since the slower the speed of ascent the more energetic the cleaning, the anode being subjected to the jets of water under pressure for a greater length of time.

Finally, when the lifting means 5 reach the upper limit position the anode is situated between the plates 3 which move successively from the parallel closed position to the angular open position 3*a*. Each time the plates reach the closed limit position, represented by the solid lines in the drawings, they strike the surfaces of the anode and produce the straightening or flattening of the plate thereof. The number of times the anode has to be struck may be determined by a selector.

Once the anode has been straightened is lowered at a uniform rate which is normally greater than the rate of ascent.

Optionally, the anode may be irrigated with water under pressure during its descent in order to eliminate from the lead plate all those particles which were left by the upward irrigation and removed by the plates 3 during the flattening phase.

Finally, once it is clean the anode is replaced on the carriage 24 which moves automatically until a new dirty anode is in place to be picked up by the lifting means 5 in order to be cleaned.

Figure 6:
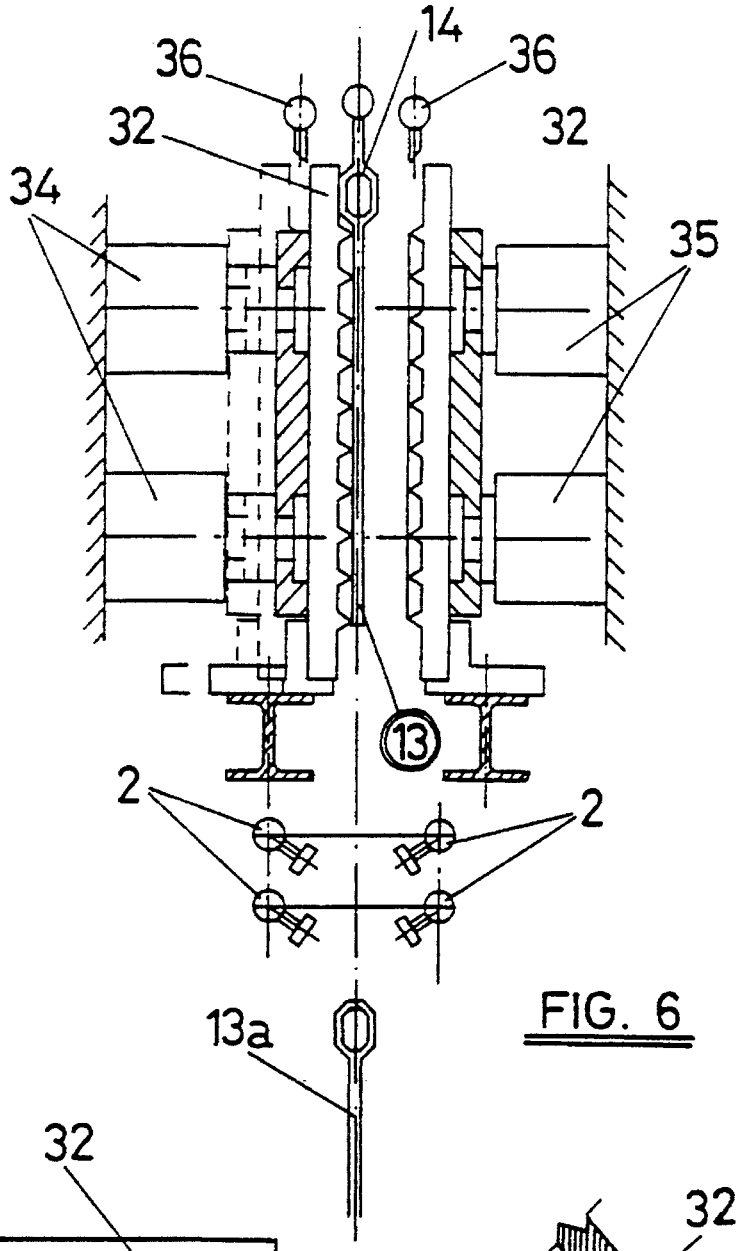
FIG. 6 is a similar view to that of FIG. 1 showing an alternative embodiment.
Figure 7:
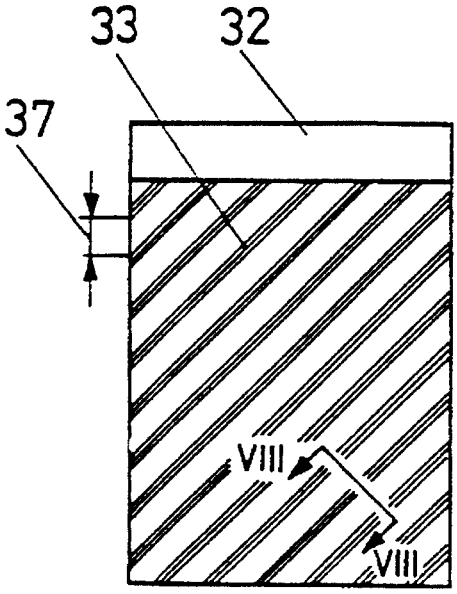
FIG. 7 is an inner view of one of the plates which form part of the machine shown in FIG. 6.
Figure 8:
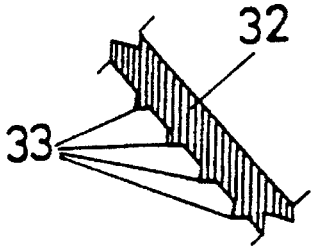
FIG. 8 is a section taken along the line VII—VII of FIG. 7.

FIGS. 6 and 8 represent an alternative embodiment of the machine in which the cutting rollers 1 and the flattening plates 3 are replaced by two parallel plates 32 which, as is best seen in FIGS. 7 and 8, have inner surfaces that are crossed with diagonal grooves 33 with a cutting edge. The two plates 32 are the same such that when they are placed in an opposing position the grooves 33 of each one cross each other.

The plates 32 are mounted by means of actuating cylinders 34 and 35, the cylinders 34 which support one of the plates being of greater in section than those of the opposite plate. Below the position occupied by the plates 32 are situated the sets of nozzles 2, as in the embodiment described above.

When the anode 13 reaches its upper position by the lifting of the suspension means 5 (FIG. 6) it is positioned between the plates 32 and when the cylinders 34 and 35 are activated they press the anode 13, the grooves 33 causing the deposits to break, and at the same time carry out the straightening or flattening of the plate of the anode.

For the safety of the anode two independent systems are provided. One of them consists of limiting the travel of the plates 32 in such a way that at their minimum distance their separation is equal to the thickness of the anode. The second safety system is based on controlling the maximum force which the two plates can exert between them. This is achieved by controlling the hydraulic circuit which actuates them.

A second set of nozzles is arranged above the plates 32 for supplying water under pressure.

The travel of the cylinders 34 is calculated so that in the position of maximum expansion they rest against the anode 13 without moving it from the central plane of the machine. Afterwards the cylinders 35 are activated and which, as they are smaller in section, cannot cause the cylinders 34 to move back, thereby ensuring that the anode 13 is positioned along the central vertical plane of the machine.

The cleaning process by means of the machine represented in FIG. 6 is similar to that described with reference to the FIGS. 1 to 5 as far as the handling of the anode is concerned in order to situate it in the highest position between the plates 32. At this point the cylinders 34 are operated until they reach their maximum travel of expansion, at which point the plate 32 rests against the anode 13. Subsequently the opposing plate is advanced by means of the cylinders 35 until said plate presses against the anode 13 with all the force for which it has been previously set. The pressure with which the plates 32 act on the anode 13, the time of application of this force and the rate of movement of the plates are all adjustable.

With the action of pressing the anode 13 the two fundamental objectives of the treatment are achieved: firstly, as the grooved plates come together the layer of sediments deposited on the surfaces of the anode 13 is cut and secondly, once the plates are in contact in the way described, a pressing action of pre-determined force and duration is applied, the aim of which is to flatten the anode.

Once the anode has been pressed, the plates 32 are pulled back into their withdrawn position, the anode is lowered by a distance equal to half the pitch 37 between the grooves of the plates (FIG. 7) and a second cycle of pressing the anode 13 is started, the same as the one described above. Finally, the plates 32 are opened again and the anode is lowered. At the same time begins the process of cleaning the plates by means of the irrigation produced by the set of nozzles 36 and, as the decent continues, by means of the jets of water under pressure supplied by the set of nozzles 2. The rate of descent can be adjusted in order to vary the length of time for which the jets of water under pressure are applied to the anode. When the descent is completed the anode is situated on the carriage 24 (FIG. 2) in order that the process can continue as previously described.

The cleaning of the anodes by means of the machine represented in FIGS. 6 to 8 does not require such high water pressures as in the case of the machine shown in FIGS. 1 to 5 and furthermore, by means of housings formed in the plates 32, it is possible to break the entire layer of sediments even close to the insulators of the anode or any other obstacle which protrudes from the surfaces thereof. Furthermore, the cleaning operation is quieter than with rollers.

In either of the variants of the machine described, the elements of which they consist may be arranged in a different order than the one described, and furthermore may even occupy a different distribution.

What is claimed is:

1. A procedure for cleaning the anodes of electrolytic tanks, in particular for eliminating the deposits of impurities which adhere to the surfaces of the anodes during the process of producing non-ferrous metals by electrolysis, characterized in that it comprises, in combination, the following stages: a) mechanically breaking the deposits on the surfaces of the anodes; b) detaching and separating the deposits, once broken, from the surfaces of the anodes; and c) subjecting the surfaces of the anodes to a flattening operation; said breaking being carried out by means of closely spaced cutting lines made in the deposits, and said detaching and separating stage being carried out by means of jets of water under pressure incident on the surfaces of the anodes.

2. A procedure according to claim 1, characterized in that for the breaking of the deposits two series of cutting lines which cross each other are made in the surface of the anode.

3. A procedure according to claim 2, characterized in that cutting lines are made by means of pairs of parallel rotating rollers which are provided on their lateral surfaces with helical cutting grooves, the anode being passed between said rollers, the separation between the grooves of both rollers being maintained approximately equal to the thickness of said anode.

4. A procedure according to claim 2, characterized in that phases of breaking and flattening are carried out together by means of two plates provided on one of their sides with fine ribs provided with a free cutting edge, said plates being opposed and pressed at the same time against the surfaces of the anode, one on each side, to simultaneously produce cutting lines in the deposits as well as the flattening of the anode.

5. A procedure according to claim 1, characterized in that before the breaking stage the anodes are subjected to an operation of irrigation in order to eliminate acids.

6. A procedure according to claim 1, characterized in that cutting lines are made by means of pairs of parallel rotating rollers which are provided on their lateral surfaces with helical cutting grooves, the anode being passed between said rollers, the separation between the grooves of both rollers being maintained approximately equal to the thickness of said anode.

7. A procedure according to claim 1, characterized in that phases of breaking and flattening are carried out together by means of two plates provided on one of their sides with fine ribs provided with a free cutting edge, said plates being opposed and pressed at the same time against the surfaces of the anode, one on each side, to simultaneously produce cutting lines in the deposits as well as the flattening of the anode.

* * * * *